US010299584B2

(12) United States Patent
Leier et al.

(10) Patent No.: US 10,299,584 B2
(45) Date of Patent: May 28, 2019

(54) ADJUSTABLE DESK

(71) Applicant: EXPECTATIONS, LLC, Puyallup, WA (US)

(72) Inventors: Christopher Henry Leier, Puyallup, WA (US); Yi-Tzu Chen, Taoyuan (TW)

(73) Assignee: Expectations, LLC, Buckley, WA (US)

( * ) Notice: Subject to any disclaimer, the term of this patent is extended or adjusted under 35 U.S.C. 154(b) by 0 days.

(21) Appl. No.: 15/691,908

(22) Filed: Aug. 31, 2017

(65) Prior Publication Data

US 2018/0125233 A1 May 10, 2018

Related U.S. Application Data

(60) Provisional application No. 62/382,848, filed on Sep. 2, 2016.

(51) Int. Cl.

| | |
|---|---|
| ***A47B 83/02*** | (2006.01) |
| ***A47B 13/02*** | (2006.01) |
| ***A47B 13/08*** | (2006.01) |
| ***A47B 17/02*** | (2006.01) |
| ***A47B 17/03*** | (2006.01) |
| ***A47B 17/06*** | (2006.01) |
| ***A47C 3/18*** | (2006.01) |
| ***A47C 3/40*** | (2006.01) |
| ***A47C 7/00*** | (2006.01) |
| ***A47B 9/08*** | (2006.01) |

(Continued)

(52) U.S. Cl.

CPC ..... *A47B 83/02* (2013.01); *A47B 9/08* (2013.01); *A47B 13/023* (2013.01); *A47B 13/081* (2013.01); *A47B 13/088* (2013.01); *A47B 17/02* (2013.01); *A47B 17/03* (2013.01); *A47B 17/065* (2013.01); *A47B 21/02* (2013.01); *A47B 21/0314* (2013.01); *A47B 39/023* (2017.08); *A47C 3/18* (2013.01); *A47C 3/40* (2013.01); *A47C 7/004* (2013.01); *A47B 2013/024* (2013.01); *A47B 2200/0036* (2013.01); *A47B 2200/0043* (2013.01)

(58) Field of Classification Search

CPC ..... A47B 83/02; A47B 39/023; A47B 13/023; A47B 2013/024; A47B 2013/025; A47B 17/02; A47B 17/03; A47B 17/065; A47B 21/02; A47B 21/0314; A47C 3/40; A47C 7/004; A47C 2200/0043

USPC ... 297/135, 137, 141, 142, 173, 172, 174 R; 108/25, 26

See application file for complete search history.

(56) References Cited

U.S. PATENT DOCUMENTS

| | | | | |
|---|---|---|---|---|
| 367,037 A | | 7/1887 | Gough et al. | |
| 1,023,620 A | * | 4/1912 | Burge | A47C 3/026 248/405 |

(Continued)

*Primary Examiner* — Jose V Chen

(74) *Attorney, Agent, or Firm* — Dicke, Billig & Czaja, PLLC

(57) ABSTRACT

A desk has a base that rests on an underlying floor surface, a work surface that is supported by the base, and a seat that is rotatably connected to the base for rotation between a first position, located in a conventional position behind the desk so a person may sit at the desk, and a second position, located to one side of the desk so that a person may instead stand at the desk. The seat is adjustable radially relative to its axis of rotation, vertically up and down relative to the floor surface, and angularly toward its axis of rotation.

26 Claims, 10 Drawing Sheets

(51) Int. Cl.

| | |
|---|---|
| ***A47B 21/02*** | (2006.01) |
| ***A47B 21/03*** | (2006.01) |
| ***A47B 39/02*** | (2006.01) |

(56) References Cited

U.S. PATENT DOCUMENTS

| | | | | | |
|---|---|---|---|---|---|
| 2,488,222 | A * | 11/1949 | Morgan | A47B 39/04 | 16/363 |
| 2,673,595 | A * | 3/1954 | Kump, Jr. | A47B 39/04 | 297/172 |
| 2,732,007 | A * | 1/1956 | MacWhirter | A47B 39/02 | 108/6 |
| 4,134,614 | A * | 1/1979 | Fielding, Sr. | A47B 83/008 | 248/118 |
| 5,697,668 | A * | 12/1997 | Chao | A47B 39/02 | 297/135 |
| 5,704,298 | A * | 1/1998 | Corpuz, Jr. | A47B 17/065 | 108/50.01 |
| 5,765,910 | A * | 6/1998 | Larkin | A47B 83/001 | 297/172 |
| 6,269,578 | B1 * | 8/2001 | Callegari | F41A 23/02 | 297/172 |
| 6,439,657 | B1 * | 8/2002 | Tholkes | A47B 9/02 | 297/135 |
| 6,644,748 | B2 * | 11/2003 | Tholkes | A47B 9/00 | 248/280.11 |
| 6,776,452 | B2 * | 8/2004 | Onishi | A47B 83/02 | 108/143 |
| 6,895,709 | B1 * | 5/2005 | Krien | A47B 83/02 | 42/94 |
| 7,314,248 | B2 * | 1/2008 | Mabon | A47B 9/08 | 297/118 |
| 7,571,959 | B2 * | 8/2009 | Griepentrog | A47B 39/00 | 16/35 R |
| 7,823,520 | B2 * | 11/2010 | Mayben | A47B 57/00 | 108/129 |
| 7,823,973 | B2 * | 11/2010 | Dragusin | A47C 7/72 | 108/50.01 |
| 8,104,828 | B2 | 1/2012 | Knighton | | |
| 9,144,300 | B2 * | 9/2015 | Cotey | A47B 3/0815 | |
| 9,549,609 | B2 * | 1/2017 | Constantino | F16M 11/42 | |
| 9,596,929 | B2 * | 3/2017 | Koulizakis | A47B 83/02 | |
| 2006/0225624 | A1 * | 10/2006 | Grace | A47B 3/002 | 108/26 |
| 2007/0056482 | A1 * | 3/2007 | Robinson | A47B 3/06 | 108/25 |
| 2016/0302571 | A1 * | 10/2016 | McBride | A47B 19/06 | |

* cited by examiner

ADJUSTABLE DESK

FIELD OF THE INVENTION

The present invention relates to work spaces and more specifically to desks relative to which a person may sit or stand.

BACKGROUND OF THE INVENTION

Desks have been around for a long time. For example, see U.S. Pat. No. 367,037 to Speakman et al. There has been a recent trend toward desks at which a person may choose to sit or stand. For example, see U.S. Pat. No. 8,104,828 to Knighton. An object of the present invention is to provide an improved desk at which a person may sit or stand.

SUMMARY OF THE INVENTION

One aspect of the present invention may be described in terms of a desk having a base, a work surface supported by the base, and a chair rotatably connected to the base for rotation between a first position, located in a convention position behind the desk so a person may sit at the desk, and a second position, located to one side of the desk so that a person may instead stand at the desk.

Additional features and benefits of the present invention will become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

FIGS. 1-5 show a preferred embodiment desk 100 constructed according to the principles of the present invention. Generally speaking, the desk 100 includes a frame 110, at least one work surface 130 supported by the frame 110, and at least one seat 190 supported by the frame 110. Unless otherwise noted, the components of the desk 100 are steel tubes that are interconnected by known means, including welding and/or nuts and bolts, depending on conventional design criteria such as ease of shipping and assembly.

Figure 4:
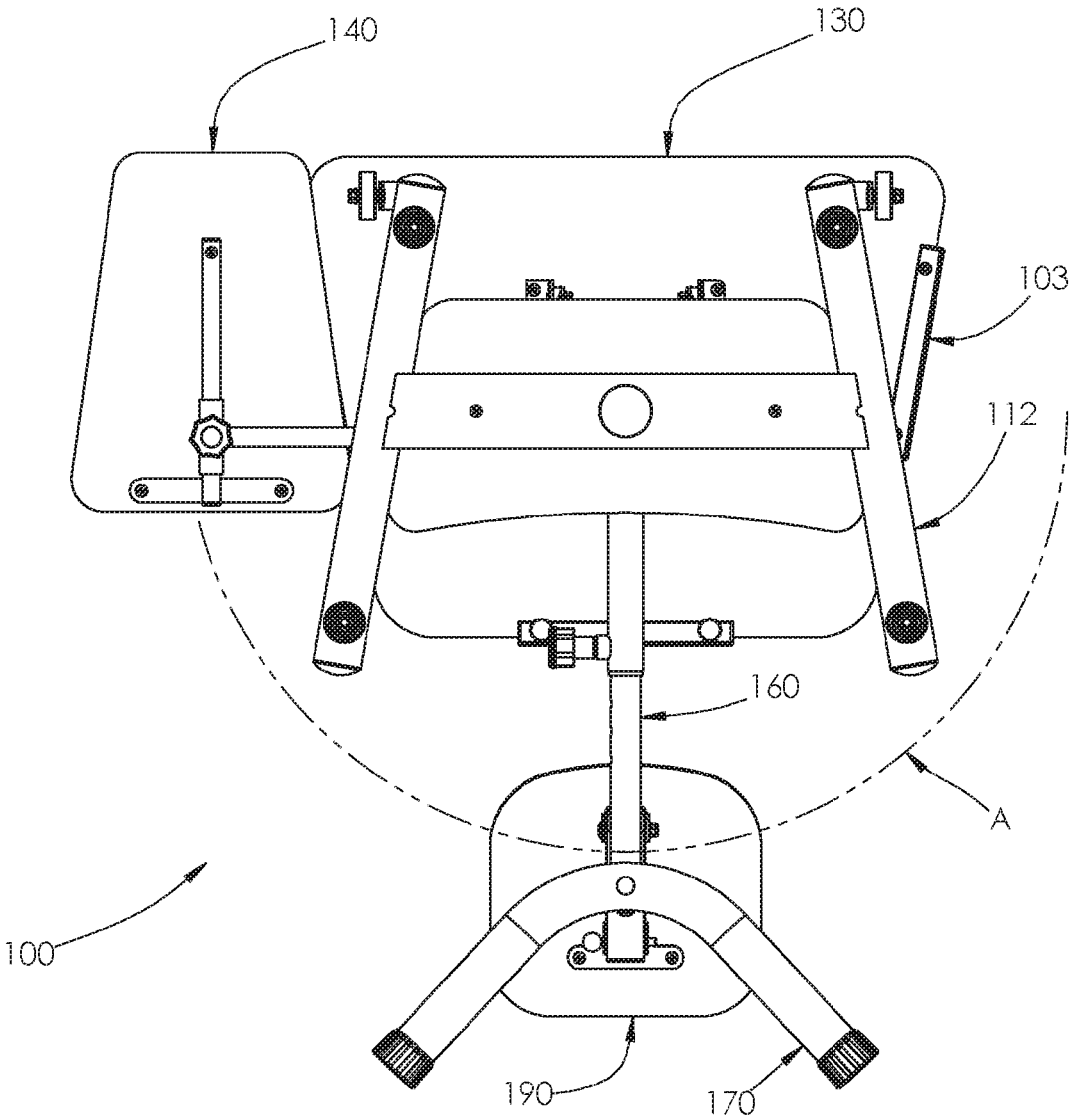
FIG. 4 is a bottom view of the desk of FIG. 1.

The frame 110 includes a rigid base 112 configured to occupy a stable position on top of an underlying floor surface. As shown in FIG. 4, the base 112 may be described in terms of a generally H-shaped member having a rectangular tube rigidly interconnected between left and right cylindrical tubes. Adjustable leveling feet 114 are threaded upward into the cylindrical tubes proximate the forward and rearward ends thereof. Rollers 116 are mounted on the forward ends of the cylindrical tubes to accommodate rolling of the desk 100 across the floor when the desk 100 is tilted forward to bring the rollers 116 into contact with the floor (and lift the feet 114 out of contact with the floor). A steel foot plate 118 is secured in place on top of the rectangular tube and between the cylindrical tubes.

An adjustable length post 120 has a lower round tube 121 and an upper square tube 122. The lower end of the square tube 122 is telescopically mounted inside the upper end of the round tube 121, and a bushing facilitates a snug sliding relationship therebetween. A conventional fastener 123 is selectively inserted through a hole in the lower tube 121 and any of several holes in the upper tube 122 to lock the tube 120 at a desired length (and is temporarily removed to adjust the length). A conventional assist mechanism, such as a gas spring, is preferably disposed inside the lower tube 121 and interconnected between the lower tube 121 and the upper tube 122 to resist downward telescoping and to assist upward telescoping of the upper tube 122 relative to the lower tube 121. The lower end of the lower tube 121 is rigidly secured to the base 112 in such a manner that the post 120 extends vertically upward when the base 112 is level relative to the floor.

Figure 1:
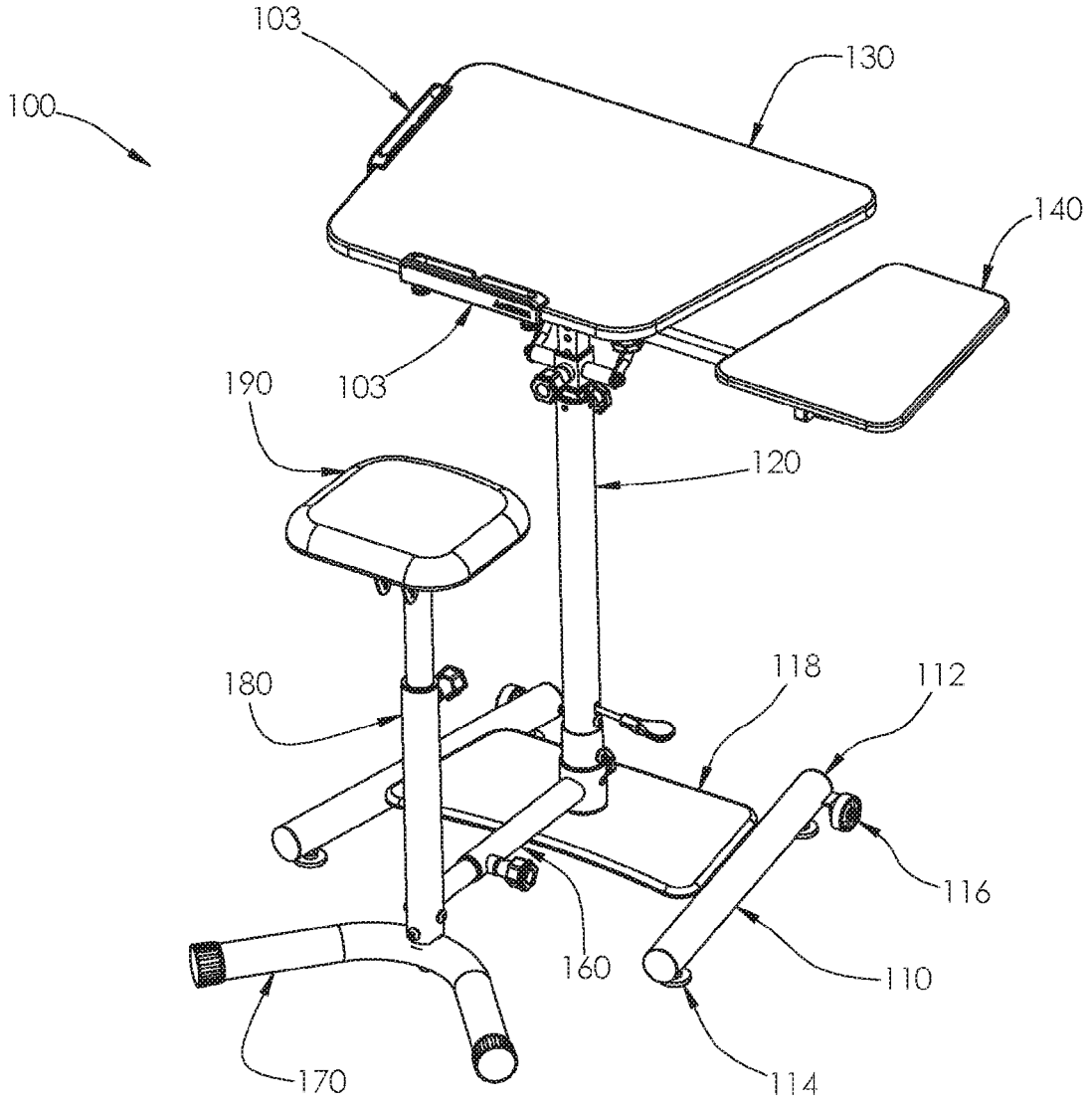
FIG. 1 is an isometric view of a desk constructed according to the principles of the present invention.
Figure 2:
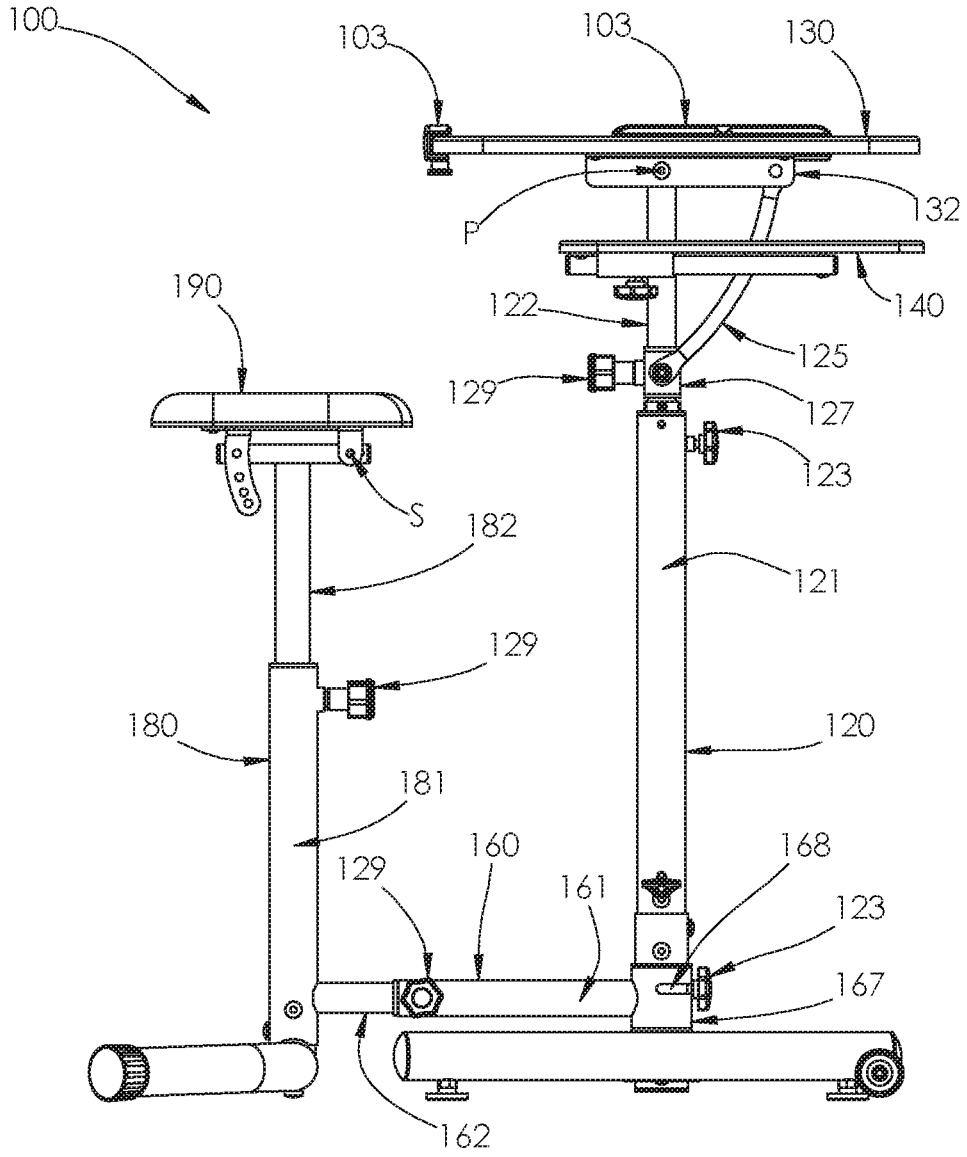
FIG. 2 is a side view of the desk of FIG. 1.
Figure 3:
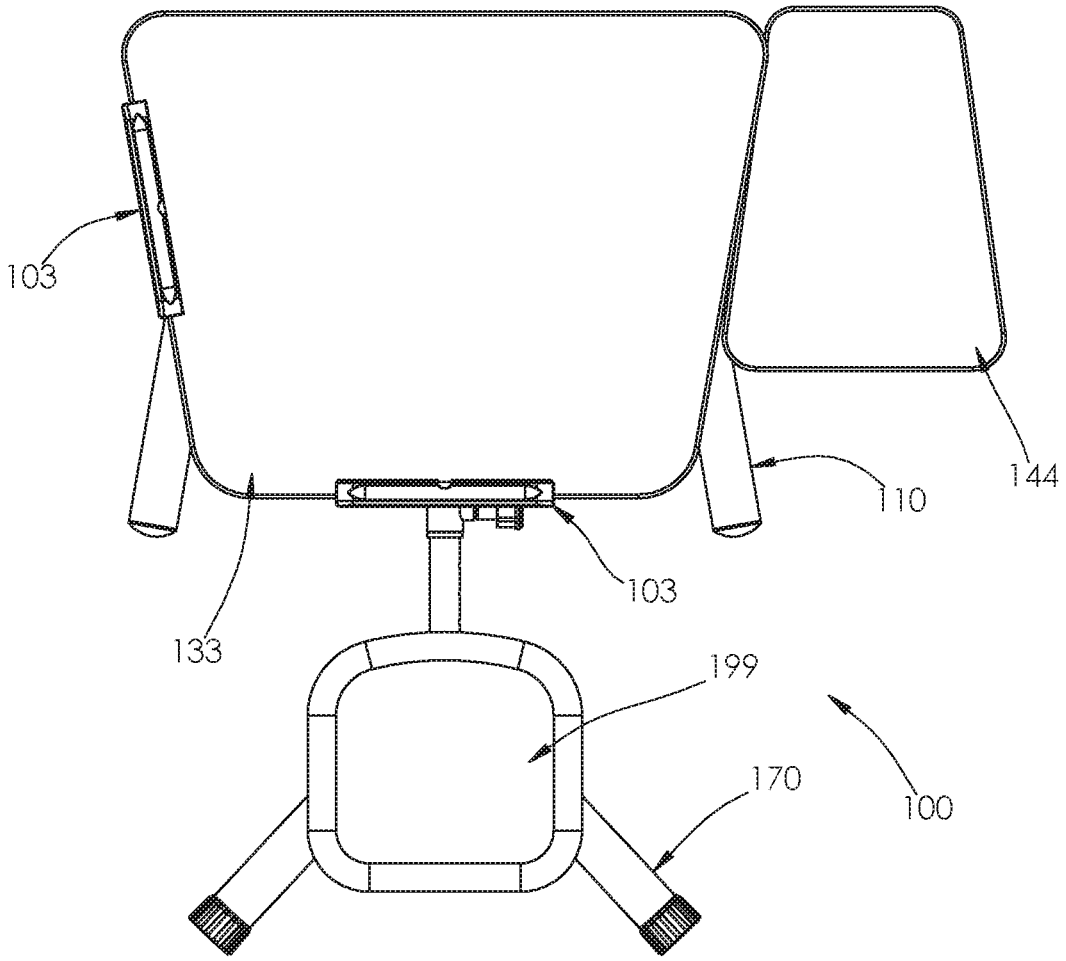
FIG. 3 is a top view of the desk of FIG. 1.
Figure 5:
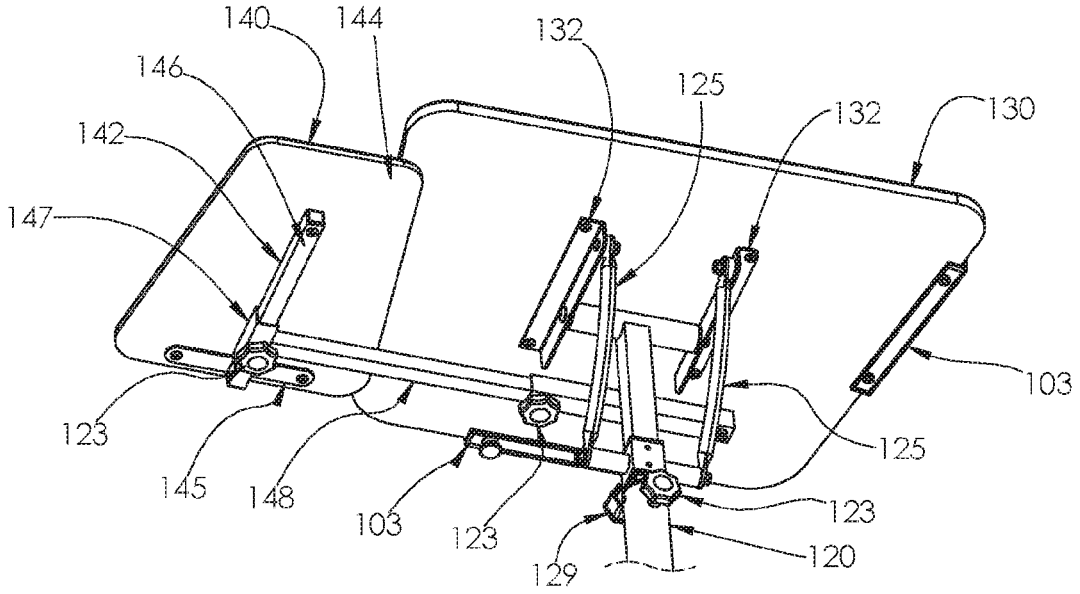
FIG. 5 is a bottom perspective view of a desk top portion of the desk of FIG. 1.

With reference to FIGS. 2 and 5, the upper end of the upper tube 122 is pivotally connected to a primary desk top or work surface 130, thereby defining a pivot axis P. The work surface 130 includes a board 133 and underlying support brackets 132. As shown in FIG. 5, the brackets 132 are angle iron members having first flanges that lie flat against the bottom of the board 133 and are secured in place by screws, and second flanges that extend perpendicularly downward from the bottom of the board 133. A conventional bolt extends through the second flanges and a tube disposed therebetween, as well as through bushings occupying the ends of the tube to maintain the longitudinal axis of the bolt in coaxial alignment with the pivot axis P. The tube is rigidly secured to the upper end of the upper post member 122, thereby defining a T-shaped configuration.

Left and right braces 125 have upper ends pivotally connected to respective flanges 132, forward of the pivot axis P, and opposite, lower ends pivotally connected to opposite sides of a sleeve or sliding member 127, vertically beneath the pivot axis P. The ends of the braces 125 pivot about axes extending parallel to the pivot axis P. In operation, the braces 125 link pivoting of the desk top 130 about the pivot axis P to movement of the sliding member 127 along the upper post member 122. A conventional fastener 129 is selectively inserted through a hole in the sliding member 127 and one of several holes in the upper post member 122 to lock the desk top 130 in a desired angle (and is temporarily removed to adjust the angle).

A first optional desk top or work surface 140 is adjustably mounted on the upper post member 122 proximate the upper end thereof. The desk top 140 includes a board 144 and an underlying support bracket 142. The bracket 142 may be described as a T-shaped member that includes a steel bar 145 and a square tube 146. The bar 145 extends laterally beneath the board 144 proximate a rearward edge thereof, and is secured thereto by screws inserted upward through the ends of the bar 145 and threaded into the board 144. The square tube 146 extends longitudinally beneath the center of the board 144, and has a rearward end welded beneath an intermediate portion of the bar 145, and an opposite, forward end secured to a forward portion of the board 144 by a screw inserted upward through the tube 146 and threaded into the board 144. A spacer having the same thickness as the bar 145 is disposed between the tube 146 and the board 144 to maintain a consistent gap between the board 144 and an intermediate portion of the tube 146.

Before the rear end of tube 146 is secured to the board 144, a square sleeve or sliding member 147 is sleeved onto the intermediate portion of the tube 146 for sliding movement relative thereto. Another conventional fastener 123 is inserted through a hole in the sleeve 147 and any of several holes in the tube 146 to prevent sliding of the former relative to the latter (and temporarily removed to adjust the former relative to the latter). In other words, the bracket 142 and the board 144 are selectively adjustable back and forth along the sleeve 147.

An adjustable length arm 148 has an inboard square tube and an outboard square tube. The inboard end of the outboard tube is telescopically mounted inside the outboard end of the inboard tube. Another conventional fastener 123 is selectively inserted through a hole in the inboard tube and one of several holes in the outboard tube to resist telescoping (and temporarily removed to allow telescoping). The outboard end of the outboard tube is rigidly secured to the sleeve 147 and extends perpendicular thereto. The middle of the inboard tube is rigidly mounted on the upper post member 122, beneath the brackets 132, in such a manner that the arm 148 extends perpendicular to the post (and parallel to the floor surface). As a result, the bracket 142 and the board 144 are selectively adjustable laterally relative to the post 120 (and the desk top 130). During assembly, the outboard tube may alternatively be inserted into an opposite, second outboard end of the inboard tube, thereby placing the desk top 140 on the opposite, left side of the desk top 130.

Figure 6:
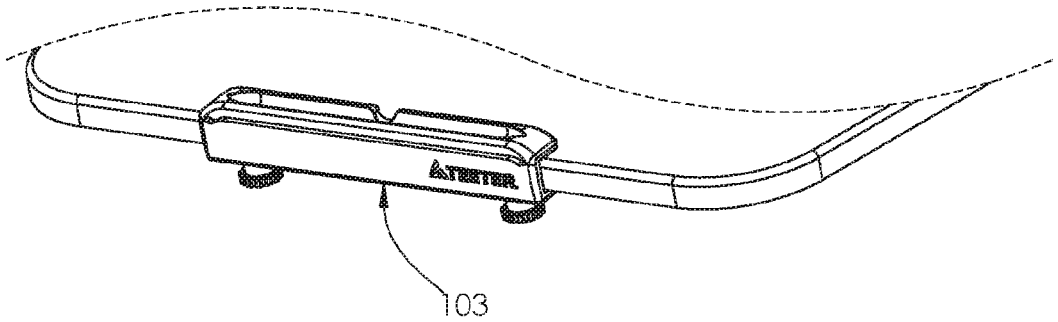
FIG. 6 is a rear perspective view of an accessory on the desk top portion of FIG. 5.
Figure 7:
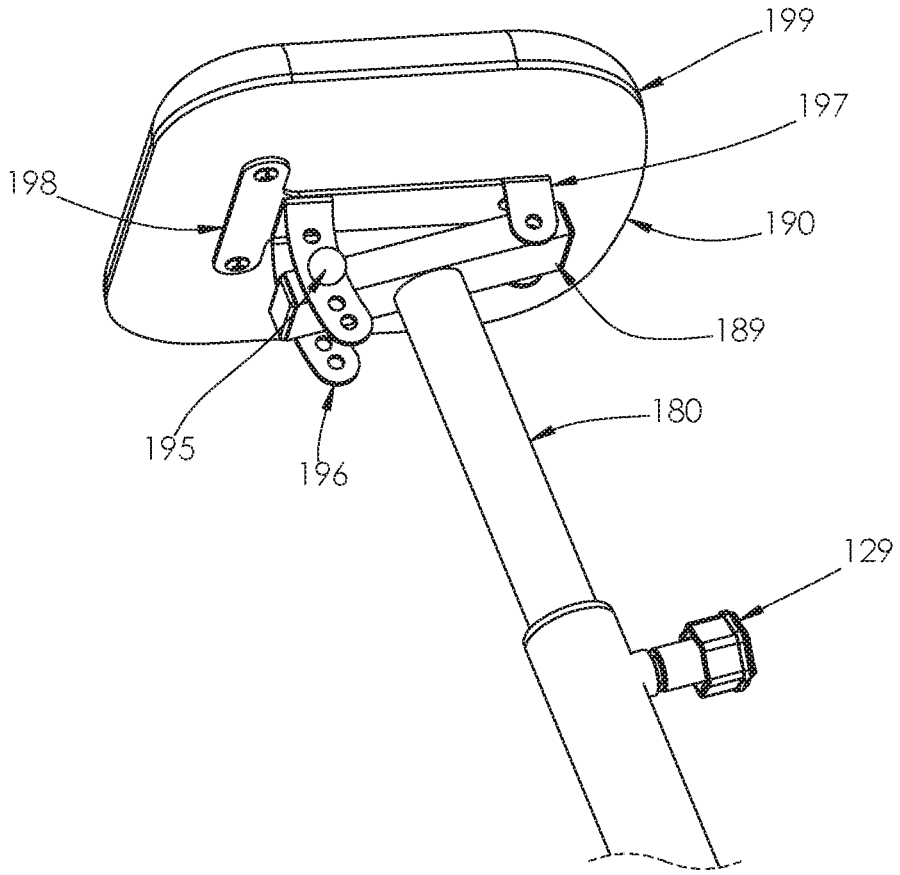
FIG. 7 is a bottom perspective view of a seat portion of the desk of FIG. 1.

An optional accessory 103 is releasably mounted on a front edge of the board 130, and an identical optional accessory 103 is shown on a side edge of the board 130 (without being fastened thereto). With reference to FIG. 6, each accessory 103 may be described as having (1) a C-shaped profile that defines an inwardly opening channel; (2) a front panel or logo area that faces away from the channel; and (3) an upwardly opening compartment. The channel accommodates the thickness of the board 133, and two fasteners are threaded upward through the bottom of the accessory 103 and against the bottom of the board 133 to retain the accessory in place along an edge of the board 133. The inwardly facing edge of the accessory 103 may function as a paper stop or book rest, for example, and the upwardly opening compartment may function as a pencil holder, for example.

An adjustable length arm 160 has a radially inward cylindrical tube 161 and a radially outward tube 162. The inward end of the outward tube 162 is telescopically mounted inside the outward end of the inward tube 161. Another conventional fastener 129 is selectively inserted through a hole in the inward tube 161 and one of several holes in the outward tube 162 to lock the arm 160 at a desired length (and temporarily removed to adjust the length of the arm 160). The inward end of the inward tube 161 is rigidly secured to a sleeve 167 and extends perpendicular thereto. The sleeve 167 is rotatably mounted on the lower post tube 121 just above the foot platform 118. Another conventional fastener 123 is inserted through a slot in the sleeve 167 and threaded into the lower post member 121 to secure the sleeve 167 against axial movement along the post 120 and to limit rotational movement about the post 120 to ninety degrees left of center and ninety degrees right of center (see arc A in FIG. 4).

The outward end of the outward tube 162 is rigidly connected to a discrete adjustable length post 180, which extends perpendicular to the arm 160 and perpendicular to the underlying floor surface. The post 180 has a lower tube 181 and an upper tube 182. The lower end of the upper tube 182 is telescopically mounted inside the upper end of the lower tube 181. Another conventional fastener 129 is selectively inserted through a hole in the lower tube 181 and one of several holes in the upper tube 182 to lock the post 180 at a desired length (and temporarily removed to adjust the length). The lower end of the lower tube 181 is rigidly secured to a discrete base 170 in such a manner that the post 180 extends vertically upward when the base 170 is level relative to the floor.

The upper end of the upper tube 182 is pivotally connected to a seat 190, which includes a padded support 199 and an underlying support bracket 198. In this regard, the bracket 198 includes an I-shaped steel plate 197 having a rearward end that lies flat against the bottom of the padded support 199 and is secured thereto by screws extending through the plate 197 and into the support 199, and an opposite forward end having left and right tabs that have been bent ninety degrees to project perpendicularly downward from the bottom of the padded support 199. A screw is inserted through a central portion of the forward end and threaded into the bottom of the padded support 199. A conventional bolt extends through the tabs and aligned holes in the forward end of a square tube 189 disposed therebetween to constrain the seat 190 to pivot about a pivot axis S.

Proximate an opposite, rearward end of the square tube 189, a U-shaped bracket 196 is welded to the plate 197 in such a manner that opposite first and second legs of the bracket 196 project downward away from the padded support 199, and holes through the legs are disposed at a common radial distance from the pivot axis S. A conventional spring-detent pin 195 is removably inserted through any of the pairs of holes in the legs and aligned holes in the square tube 189 to lock the seat 190 in a desired angle relative to the post 180 (and temporarily removed to adjust the angle).

In a first mode of operation, a person may sit on the seat 190 facing the work surface 130 and perform work on and/or relative to one or more of the work surfaces 130 and 140. In a second mode of operation, a person may rotate the seat 190 to either side of the work surface 130 (as suggested by the arc A in FIG. 4), stand with his feet rearward of the foot platform 118 and/or between the cylindrical base tubes, and perform work on and/or relative to one or more of the work surfaces 130 and 140. By means of the various fasteners 123 and 129, the person may adjust the height of the seat 190 and/or the work surfaces 130 and 140, the angle of the seat 190 and/or the work surface 130, and/or the position of the seat 190 and/or the position of the work surface 140 relative to the work surface 130.

Figure 8:
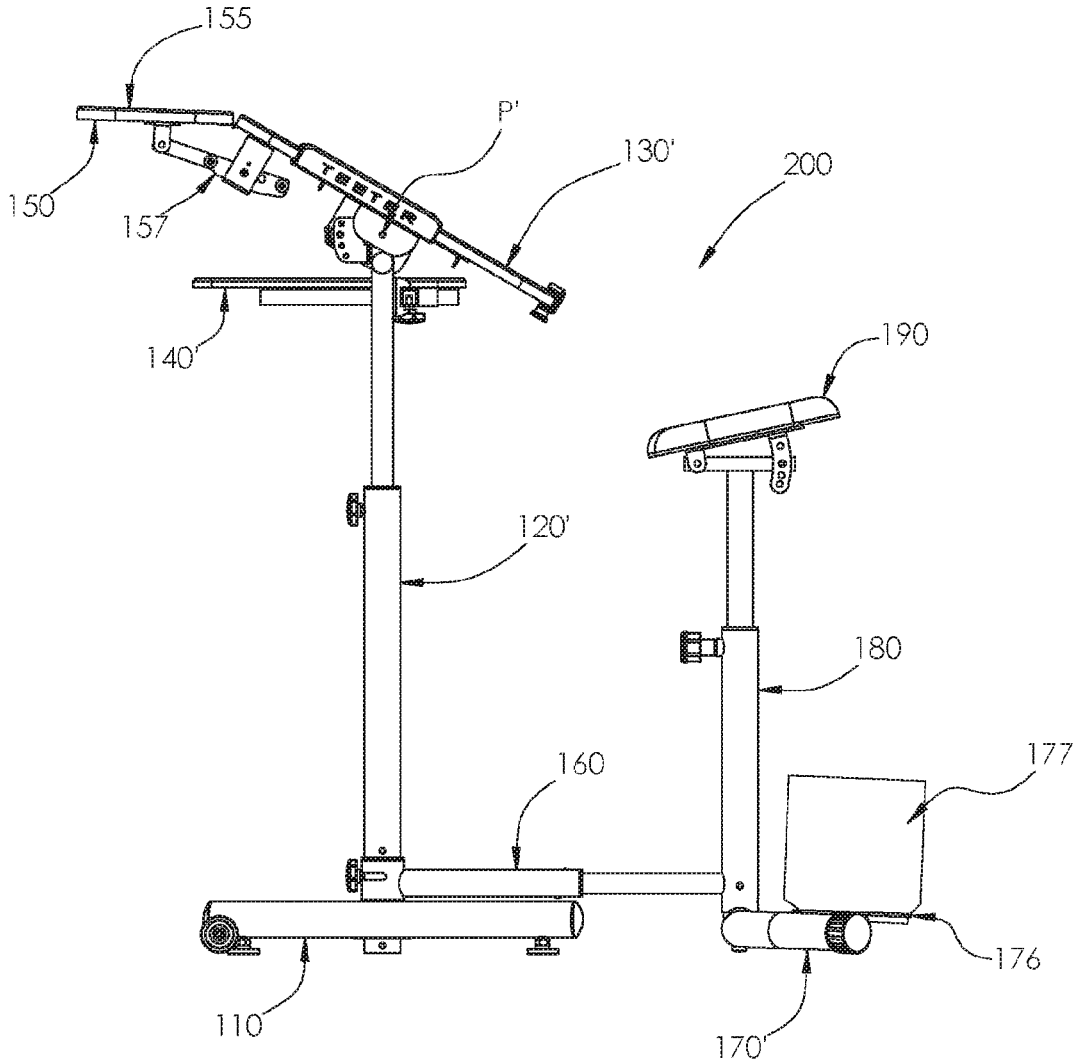
FIG. 8 is a side view of an alternative embodiment desk constructed according to the principles of the present invention.
Figure 9:
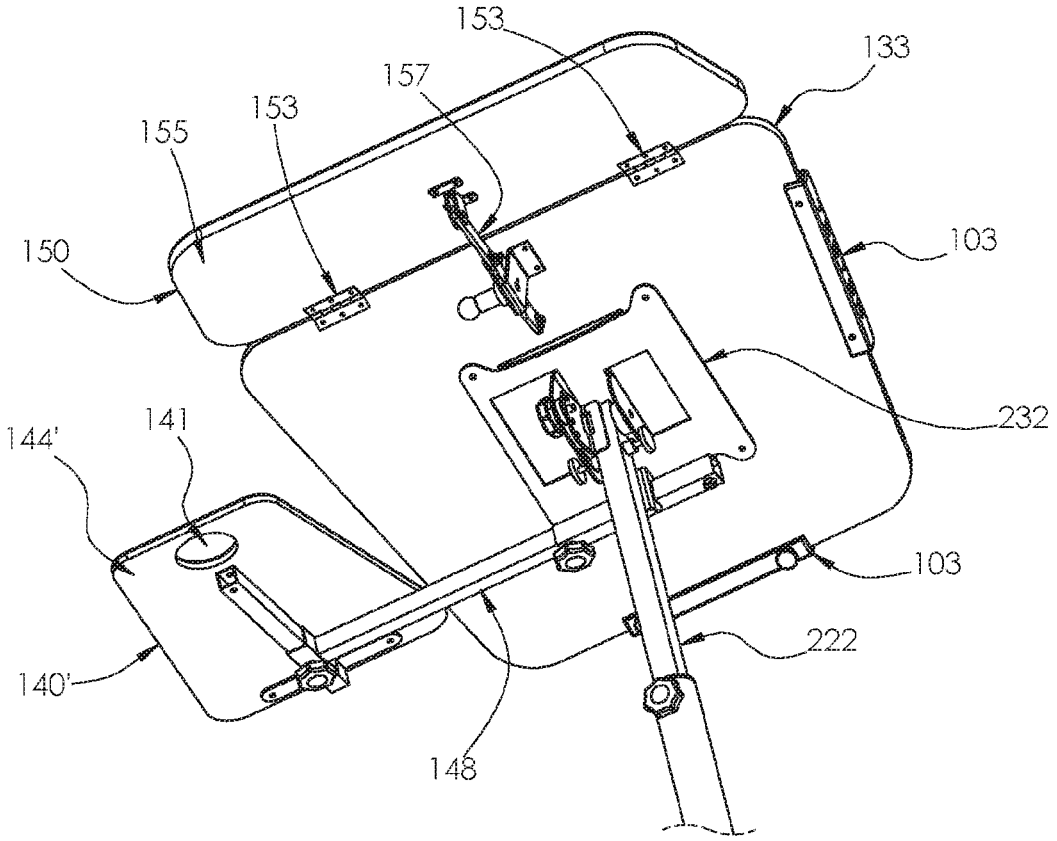
FIG. 9 is a bottom perspective view of a desk top portion of the desk of FIG. 8.

FIGS. 8-9 show some optional and/or alternative features of the subject invention embodied on an alternative embodiment desk 200 constructed according to the principles of the subject invention. As suggested by the common reference numerals, the desk 200 is similar in many respects to the desk 100, and thus, this description will focus on the differences.

The post 120' is identical to the post 120, except for the provision of an additional bracket securing the arm 148 to the upper post member 222, and the manner in which the upper post member 222 is pivotally connected to the primary desk top or work surface 130'. Similarly, the work surface 130' is identical to the work surface 130, except for the manner in which the work surface 130' is pivotally connected to the upper post member 122. In this regard, a bracket 232 is provided in the form of a steel plate having vertically oriented left and right flanges punched from the middle thereof and bent ninety degrees out of plane. The board 133 is disposed on top of a transversely extending body of the bracket 232 and secured thereto by screws inserted upward through the bracket 232 and threaded into the board 133. Spacers or bushings are disposed between the flanges and on opposite sides of the upper end of the upper post member 222, and a carriage bolt is inserted through aligned holes in these components and keyed to one of the flanges. The longitudinal axis of the bolt defines a pivot axis P' about which the work surface 130' pivots.

A hole extends through the left flange and aligns with any of several holes that extend through a bracket on the upper post member. The holes are disposed along an arc centered about the pivot axis P'. A conventional fastener 123 is selectively inserted through the hole in the left flange and one of the holes in the bracket to lock the bracket 232 (and the work surface 130') in a desired angle relative to the post 120' (and temporarily removed to adjust the angle).

The optional work surface 140' is similar to the work surface 140, except for the provision of an optional circular opening or hole 141 extending downward through the board 144' proximate a rearward edge thereof. The opening 141 is preferably sized and configured to accommodate a cup holder for holding a beverage container and/or to directly support a beverage container of a particular size and shape.

A second optional desk top or work surface 150 is pivotally mounted on the forward edge of the board 133. In this regard, the desk top 150 includes a board 155 having rearward edge that is connected to a forward edge of the board 133 by means of conventional hinges 153. In other words, the board 155 may be described as a drop-down table leaf or wing. A latch assembly 157 is interconnected between the board 155 and the board 133 to selectively adjust the angle therebetween. As on other adjustable members disclosed herein, a conventional plunger pin is selectively inserted through aligned holes in overlapping components of the latch assembly 157 to select an available orientation setting. As a result, the board 155 can be maintained in a horizontal orientation when the board 133 is angled relative to the floor surface. Among other things, this arrangement allows a computer monitor to rest on the board 155 regardless of the orientation of the board 133.

The seat base 170' is identical to the seat base 170 except for the provision of a rigid wire form 176 shaped into an arc and secured to the rear of the seat base 170' to define a circular opening. A waste basket 177 has an upper circumference that is greater than the opening, and a lower circumference that is less than the opening. As a result, the waste basket 177 rests in a stable, upright position on the wire form 176 and generally beneath the rear of the seat 190.

Figure 10:
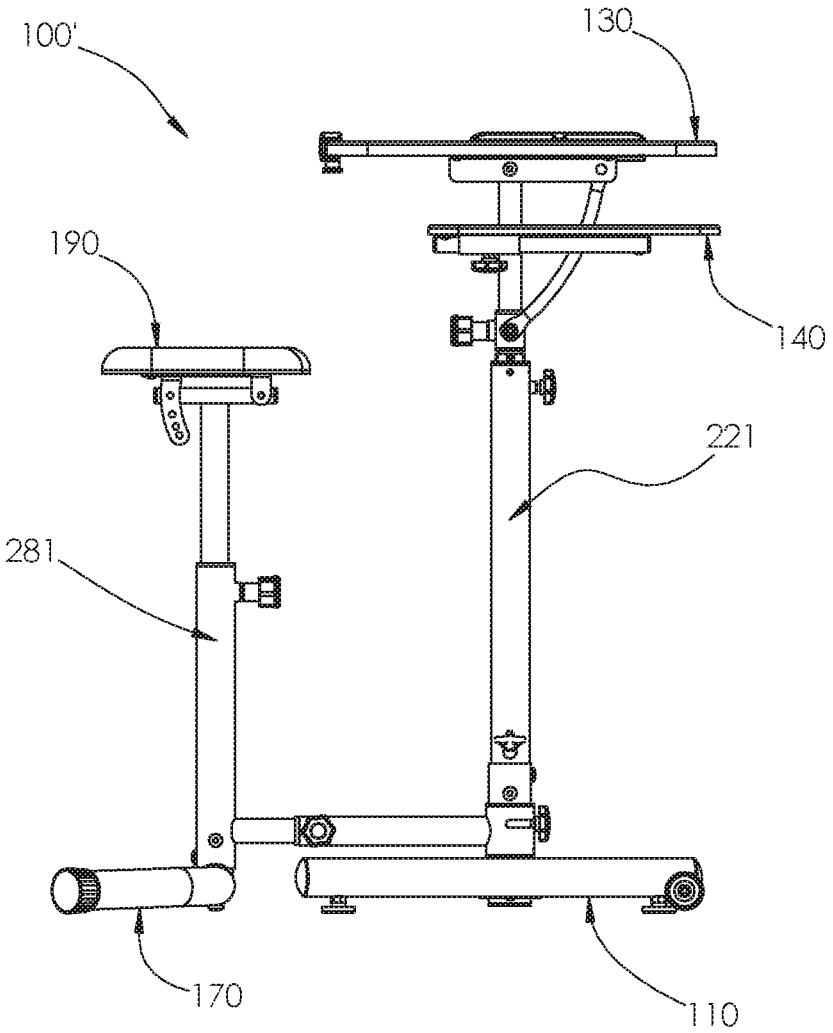
FIG. 10 is a side view of a shorter version of the desk shown in FIG. 2.

FIG. 10 shows a desk 100' that is identical to the desk 100, except that the tubes 121 and 181 have been replaced by relative shorter tubes 221 and 281, respectively, and the height adjustment assist mechanism has been removed from the tube 281. In all other respects, the tubes 221 and 181 and the desk 100' are identical to their counterparts 121 and 181 and 100, respectively. As such, this desk 100' is scaled down for relatively smaller people, including children, while using most of the components on the desk 100. As a result, a desk 100' may be sold and subsequently scaled up in size by the consumer simply by replacing the posts 221 and 281 with the posts 121 and 181, respectively (with a height adjustment assist mechanism included in the tube 281). In the alternative, a desk kit may be sold with all of the components of the desk 100, as well as the tubes 221 and 281, and the consumer may elect which size desk to assemble.

With the foregoing in mind, the present invention may be described in terms of a method of assembling a desk, comprising the steps of providing desk components including a frame, a seat, a relatively shorter first seat support, a relatively longer second seat support, a desktop, a relatively shorter first desktop support, and a relatively longer second desktop support; selecting which said seat support to use and which said desktop support to use; interconnecting the selected seat support between the frame and the seat; and interconnecting the selected desktop support between the frame and the desktop.

The subject invention has been described with reference to specific embodiments and particular applications with the understanding that features of the subject invention may be practiced individually and/or in various combinations. Also, persons skilled in the art will recognize that various modifications may be made to the depicted embodiments and/or their applications without departing from the scope of the subject invention. In view of the foregoing, the subject invention should be limited only to the extent of allowable claims that issue from this application or any related application.

What is claimed is:

1. A desk, comprising:

a frame having a base configured to rest in a stable position on top of a horizontal floor surface, and a post extending vertically upward from the base to an upper distal end;

a desktop connected to the post proximate the upper distal end;

a rigid connector link having a first end and an opposite, second end, wherein the first end is rotatably connected to the frame for rotation about a generally vertical axis relative to the frame; and a seat connected to the second end of the connector link at a radial distance from the generally vertical axis, wherein the connector link is selectively adjustable in length to adjust said radial distance and thereby adjust the seat relative to the desktop.

2. The desk of claim 1, wherein the first end of the connector link is rotatably connected to the post.

3. The desk of claim 2, wherein the post defines a cylindrical perimeter, and the first end of the connector link includes a cylindrical tube that sleeves about the cylindrical perimeter of the post.

4. The desk of claim 3, wherein the first end of the connector link further includes a first telescoping member, and the second end of the connector link includes a second telescoping member, and one said telescoping member is telescopically inserted into the other said telescoping member for telescopic movement relative thereto, and a locking member is releasably interconnected therebetween to selectively prevent said telescopic movement.

5. The desk of claim 4, wherein in at least one locked configuration of the connector link, the seat is rotatable between a first position, directly behind the desktop, and a second position, entirely out from behind the desktop, whereby a person may stand facing the desktop as an alternative to sitting on the seat and facing the desktop.

6. The desk of claim 5, wherein the base includes left and right floor engaging members that define an open space therebetween, and when the seat is rotated to the second position, a person may stand facing the desktop with his feet in the open space.

7. The desk of claim 4, wherein in at least one locked configuration of the connector link, the seat is rotatable through an arcuate path of at least 180 degrees relative to the base, and the base is disposed radially inward from said arcuate path.

8. The desk of claim 4, wherein the seat includes a separate base member configured to rest in a stable position on top of the horizontal floor surface.

9. The desk of claim 8, wherein a waste basket is mounted on the separate base member.

10. The desk of claim 1, wherein the connector link includes first and second telescoping members interconnected for telescopic movement relative to one another, and a locking member is releasably interconnected therebetween to selectively prevent said telescopic movement.

11. The desk of claim 10, wherein in at least one locked configuration of the connector link, the seat is rotatable between a first position, directly behind the desktop, and a second position, entirely out from behind the desktop, whereby a person may stand facing the desktop as an alternative to sitting on the seat and facing the desktop.

12. The desk of claim 11, wherein the base includes left and right floor engaging members that define an open space therebetween, and when the seat is rotated to the second position, a person may stand facing the desktop with his feet in the open space.

13. The desk of claim 10, wherein the seat includes a separate base member configured to rest in a stable position on top of the horizontal floor surface.

14. The desk of claim 1, wherein said radial distance is great enough to accommodate rotation of the seat through an arcuate path of at least 180 degrees relative to the base, and the base is disposed radially inward from said arcuate path.

15. The desk of claim 1, wherein the seat includes a separate base member configured to rest in a stable position on top of the horizontal floor surface.

16. The desk of claim 15, wherein a waste basket is mounted on the separate base member.

17. The desk of claim 1, wherein the desktop includes a first work platform mounted on the post for selective vertical movement relative to the base, and a second work platform adjustably mounted on the first work platform for selective horizontal movement relative to the base and the first platform.

18. The desk of claim 1, wherein the desktop is pivotally connected to the post for pivoting about a horizontal pivot axis, and a sleeve is slidably mounted on the post, and at least one brace is pivotally interconnected between the sleeve and a portion of the desktop spaced apart from the pivot axis.

19. The desk of claim 18, wherein a fastener is releasably inserted through aligned holes in the post and the sleeve to selectively maintain the sleeve in a desired position along the post, thereby maintaining the desktop in a desired orientation relative to the post.

20. The desk of claim 1, wherein the desktop includes a first work platform pivotally mounted on the post for selective inclination relative to the base, and a second work platform pivotally mounted on the first work platform for selective inclination relative to the first platform, whereby the second work platform may remain in a horizontal orientation regardless of the orientation of the first work platform.

21. A desk, comprising:

a frame having a base configured to rest in a stable position on top of a horizontal floor surface, and a post extending vertically upward from the base to an upper distal end;

a desktop;

a first connector having a first end selectively telescopically connected to the post proximate the upper distal end, and an opposite, second end pivotally connected to a first portion of the desktop thereby defining a horizontal axis; and a second connector having a first end pivotally and selectively slidably connected to an intermediate portion of the first connector, and an opposite, second end pivotally connected to a discrete, second portion of the desktop, wherein the second connector links pivoting of the desktop about the horizontal axis to sliding of the second connector along the intermediate portion of the first connector.

22. The desk of claim 21, further comprising an auxiliary desktop connected to the intermediate portion of the first connector in a manner that constrains the auxiliary desktop to remain in a fixed orientation relative to the post.

23. The desk of claim 22, wherein the auxiliary desktop is selective movable in a least one direction perpendicular to the post.

24. A desk, comprising:

a frame having a base configured to rest in a stable position on top of a horizontal floor surface, and a post extending vertically upward from the base to an upper distal end;

a desktop connected to the post proximate the upper distal end;

a rigid connector link having a first end and an opposite, second end, wherein the first end is rotatably connected to the frame for rotation about a generally vertical axis relative to the frame; and a waste basket supported on the second end of the connector link at a radial distance from the generally vertical axis.

25. The desk of claim 24, wherein the first end of the connector link is rotatably connected to the post.

26. The desk of claim 24, wherein the connector link is selectively adjustable in length to adjust said radial distance.

* * * * *